US007355503B2

(12) United States Patent
Buettner

(10) Patent No.: US 7,355,503 B2
(45) Date of Patent: Apr. 8, 2008

(54) FUSE SWITCH

(75) Inventor: Alex Buettner, Rödental (DE)

(73) Assignee: Wohner GmbH & Co. KG, Rodental (DE)

( * ) Notice: Subject to any disclaimer, the term of this patent is extended or adjusted under 35 U.S.C. 154(b) by 426 days.

(21) Appl. No.: 10/996,599

(22) Filed: Nov. 26, 2004

(65) Prior Publication Data

US 2005/0285710 A1 Dec. 29, 2005

(30) Foreign Application Priority Data

Jun. 28, 2004 (DE) ..... 10 2004 031 110

(51) Int. Cl.
*H01H 85/20* (2006.01)
*H01H 85/22* (2006.01)

(52) U.S. Cl. ..... 337/211; 337/208; 337/209; 337/284

(58) Field of Classification Search ..... 337/231, 337/208–211, 284
See application file for complete search history.

(56) References Cited

U.S. PATENT DOCUMENTS 2,313,364 A * 3/1943 Schultz ..... 337/195
3,406,365 A * 10/1968 Lameyre ..... 337/211
4,149,216 A * 4/1979 Kussy et al. ..... 361/642
4,178,061 A * 12/1979 Ahroni ..... 439/620.29
5,076,118 A * 12/1991 Lawson ..... 81/3.8
5,590,019 A * 12/1996 Fox et al. ..... 361/643
5,616,054 A * 4/1997 Quinlan ..... 439/620.26
5,969,587 A * 10/1999 Combas ..... 335/132
6,710,270 B2 * 3/2004 Naimer ..... 200/50.02
6,727,797 B1 * 4/2004 Bruchmann ..... 337/210
6,759,939 B2 * 7/2004 Sudan et al. ..... 337/211
6,794,979 B2 * 9/2004 Sudan et al. ..... 337/211

FOREIGN PATENT DOCUMENTS

DE 2903826 C2 8/1980
DE 3406815 C2 9/1985
DE 3424556 C2 10/1985
DE 29714132 U1 11/1997
DE 10054171 A1 6/2001
FR 2627010 A1 * 8/1989
GB 2042273 C2 9/1980

* cited by examiner

*Primary Examiner*—Anatoly Vortman
(74) *Attorney, Agent, or Firm*—Sughrue Mion, PLLC

(57) ABSTRACT

Fuse switch having a housing for receiving contacts and a fuse holder, which has a receptacle for a fuse element, and which is mounted in the housing such that it can pivot between at least one first and one second operating position, in which the housing receives an encoding element, which is provided at least partially in the pivot region of the fuse holder, and in which the encoding element bears a flexible blocking element, which extends in the direction of the fuse holder and senses the fuse element in terms of its outer diameter.

9 Claims, 6 Drawing Sheets

FUSE SWITCH

Figure 1:
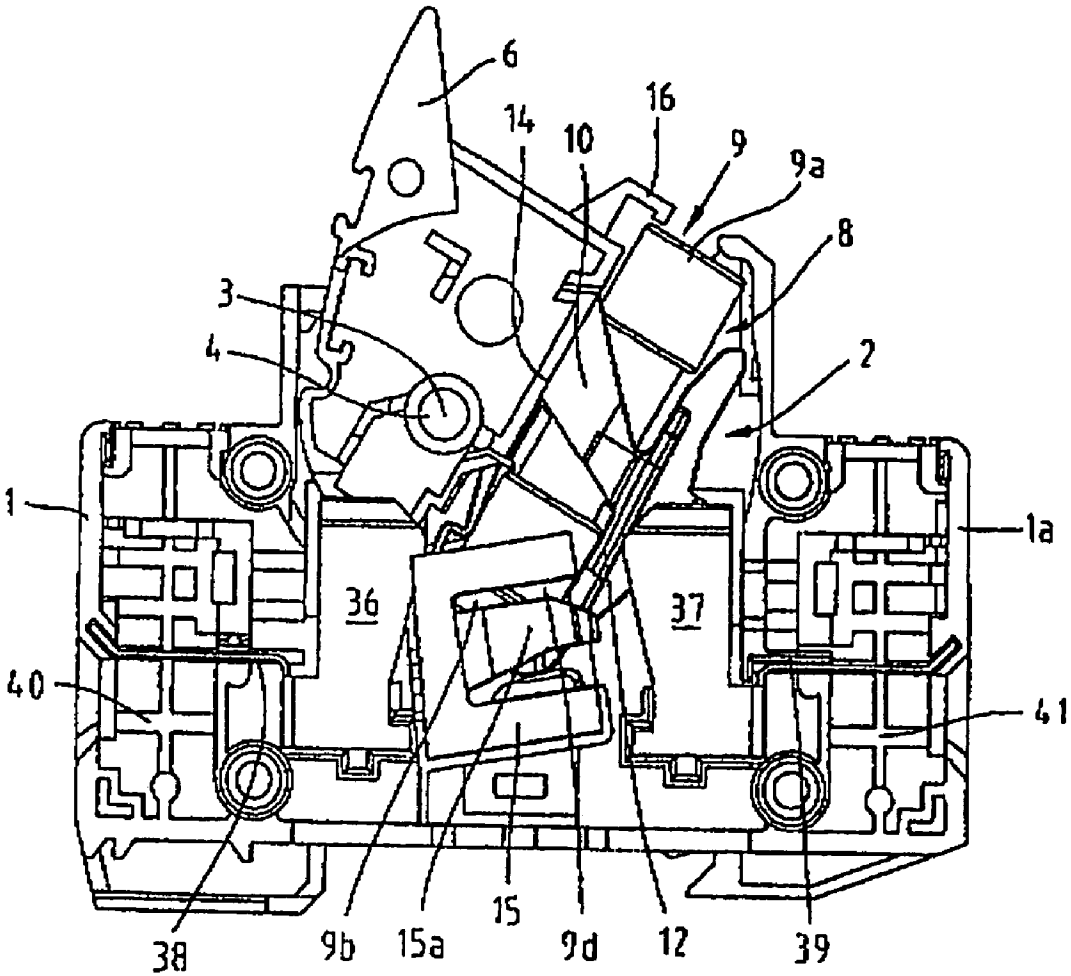

The invention relates to a fuse switch with a housing for receiving contacts and a fuse holder which has a receptacle for a fuse element.

In general existence are fuse switches having fuse holders for receiving cylinder fuses, whose size may be 10×38 mm in diameter. These fuses are symmetrical and can be inserted in any desired manner in the fuse holders.

For specific applications, cylinder fuses are used which have particular characteristics in terms of their tripping behaviour, their short-circuit strength etc. These special fuses have, as a discriminating feature, a pin at one end which is smaller than the diameter of the main body of the fuse element. In order to prevent mistaken use of a wrong fuse in the fuse holder, a measure must be provided to make sure that only the intended fuse elements can be inserted.

A corresponding measure is described in U.S. Pat. No. 5,616,054. With this fuse switch, the fuse holder has a tapered cutout which is provided in the fuse holder, extends away from said fuse holder and serves the purpose of receiving the pin of the fuse. This means that, in the event of a fuse element being inserted the wrong way round, the pin cannot reach into this recess but protrudes outwards beyond the fuse holder, which results in the fuse holder not being adopted to be moved into the operating state, since it stops against, for example, a housing edge. With this fuse switch, the encoding element is integrated in the fuse holder in the form of a cylindrical cutout extending away from said fuse holder and having a diameter which is smaller than the diameter of the main body and is matched to the pin.

One disadvantage is the fact that the fuse holder, in addition to its overall design, must also contain, in integrated fashion, the encoding element and thus has a design which is complex in terms of injection molding.

The invention is based on the object of developing a fuse switch which has a simple and effective design.

This object is achieved according to the invention by providing a fuse switch having a housing for receiving contacts and a fuse holder, which has a receptacle for receiving a fuse element and which is mounted in the housing, where at said fuse holder is arranged pivotable around a pivot point between at least one first and one second operating position, wherein further said housing receives an encoding element, which is provided at least partially in a pivot region of said fuse holder, said encoding element bearing a flexible blocking element extending in the direction of said fuse holder and being provided for sensing the fuse element in terms of its outer diameter.

The fuse switch according to the invention comprises a fuse holder for receiving a fuse element and is provided with an encoding element as a separate element with respect to the fuse holder. The encoding element is inserted in a simple manner approximately centrally in the housing when the fuse switch is assembled and thus, during manufacture, can be produced independently of the actual fuse holder. The encoding element is preferably made of plastic having a predetermined strength or elasticity.

According to the invention, an encoding element is used which, when the fuse element has been inserted correctly, senses the size of said fuse element and allows for the rotary movement or pivoting movement of the fuse holder, whereas, when the fuse element has been inserted the wrong way round, the rotary movement of the fuse holder is blocked directly by the encoding element. In addition, the rotary movement of the fuse holder is also prevented by the fuse element, which has been inserted the wrong way round, with the pin pointing outwards, also stopping against the housing edge. This means that there is in practice double protection against fuse elements being inserted incorrectly.

It is thus possible to design the fuse holder itself in a simple manner taking into consideration only the shape of the fuse element and the housing-related structures.

Figure 2:
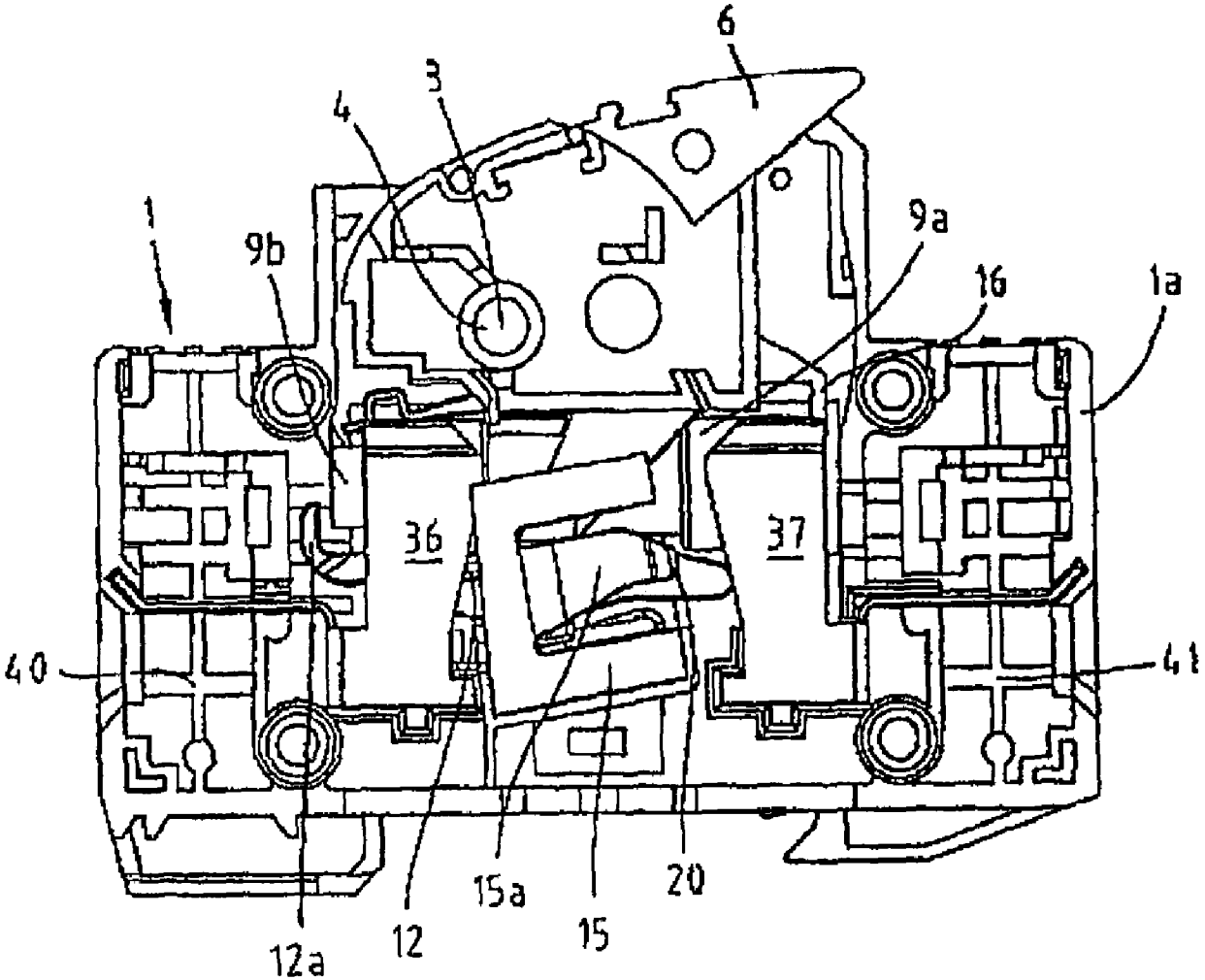
Figure 3:
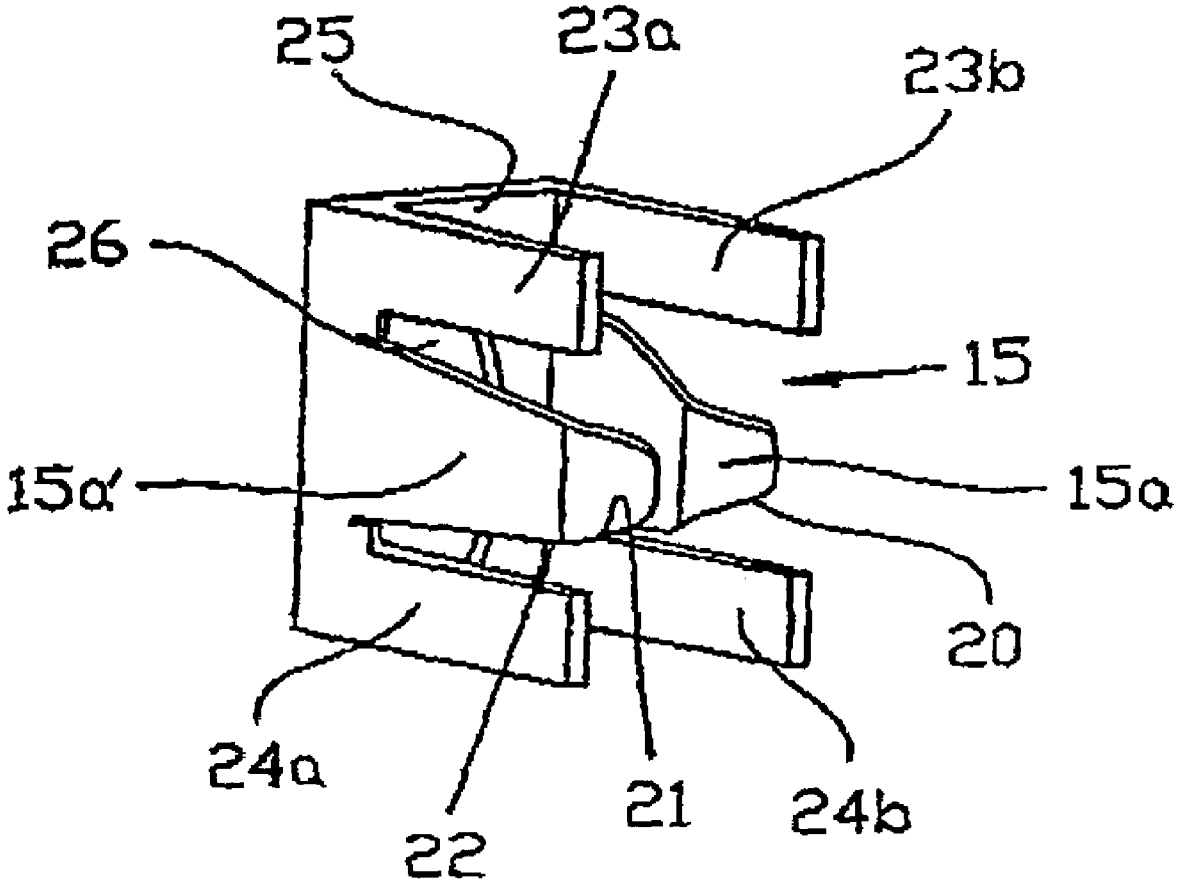
Figure 4:
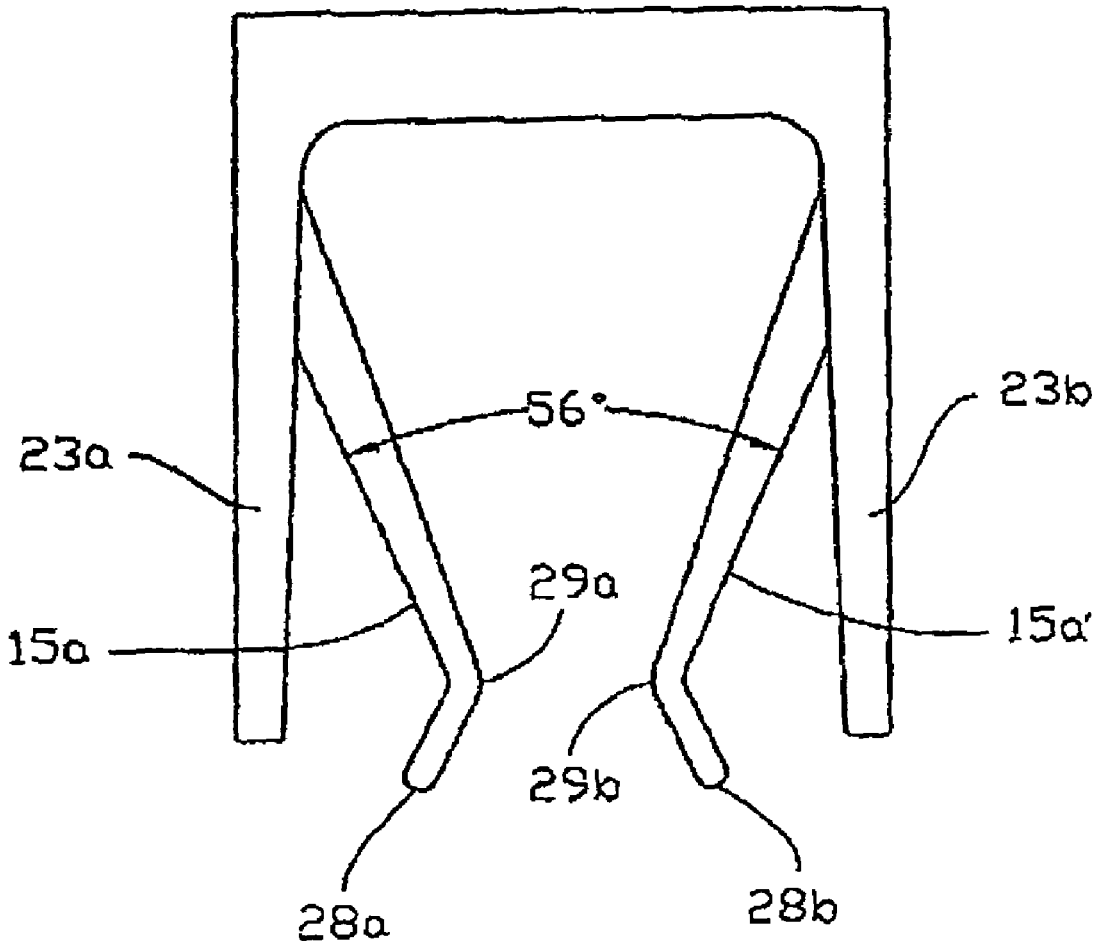
Figure 5C:
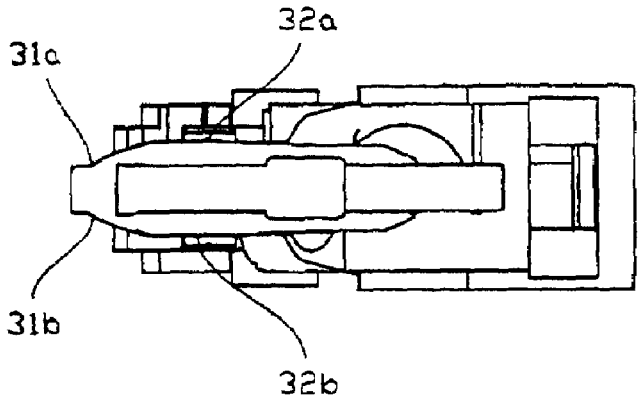
Figure 5A:
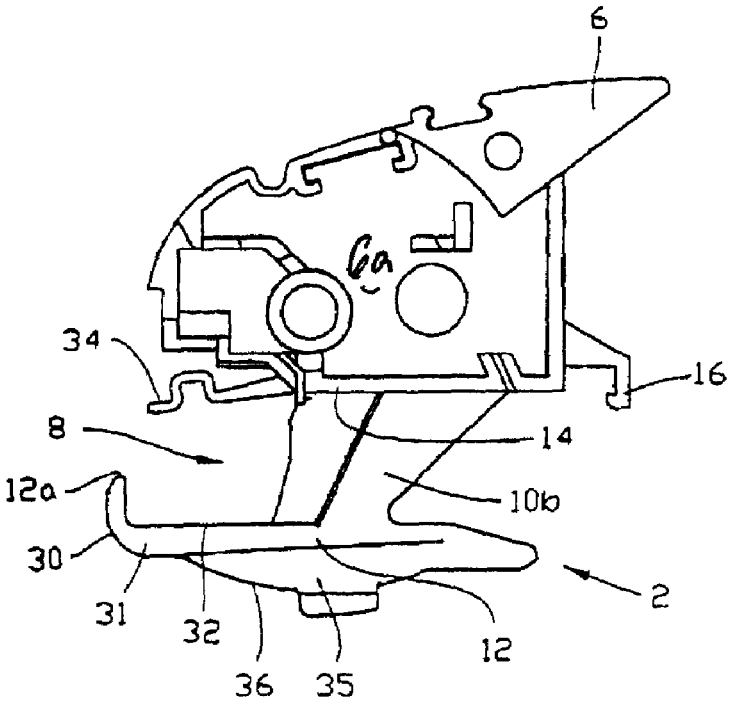
Figure 5B:
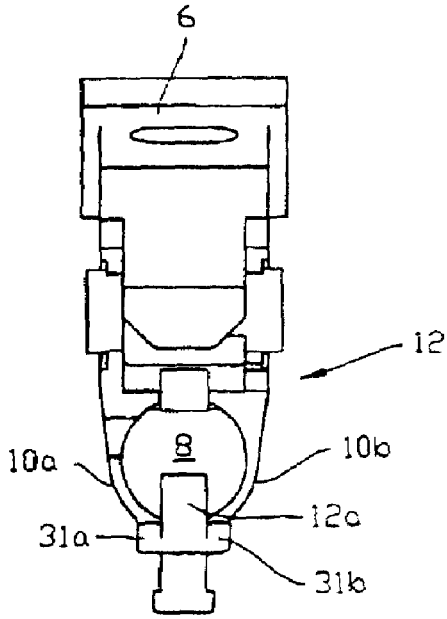
Figure 6:
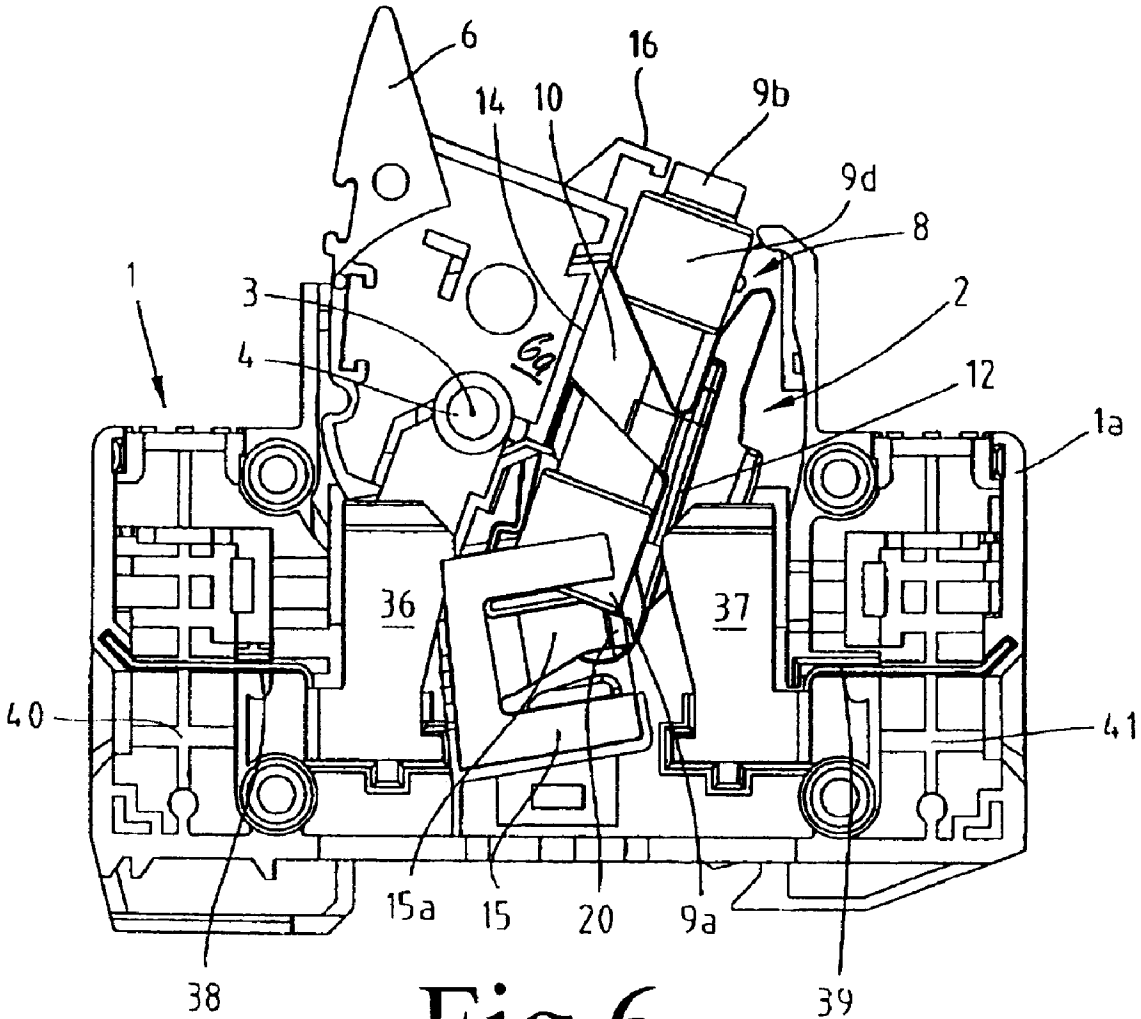

A preferred embodiment of the fuse switch according to the invention will be described below with reference to the drawing in order to explain further features. In the drawing:

FIG. 1 shows a schematic plan view of the fuse switch according to the invention, one housing half being removed, and the fuse holder being shown in that first operating state in which the fuse element can be inserted, FIG. 2 shows an illustration corresponding to FIG. 1 in which the fuse holder is moved into the operating position, FIG. 3 shows a perspective view of an encoding element, FIG. 4 shows a side view of the encoding element shown in FIG. 3, and FIGS. 5*a*, 5*b*, 5*c* show a side view, a front view and a plan view of the fuse holder, and FIG. 6 shows a view corresponding to FIG. 1 with the fuse inserted the wrong way round.

FIG. 1 shows a schematic illustration of the fuse holder according to the invention, in which, for improved illustration, the contact elements of the fuse switch are not shown, and the fuse holder 2 is illustrated in a position in which, generally, a fuse element 9 is inserted or removed. According to FIG. 1, the fuse switch comprises a housing 1, of which only the housing half 1*a* being below the fuse holder 2 is shown in FIG. 1. The fuse holder 2 has a rotation axis 3, which is formed in the embodiment illustrated by an opening 4 being formed on the housing side, a cylindrical flange, which protrudes laterally from the fuse holder 2 and whose outer diameter corresponds to the inner diameter of the opening 4, engaging in said opening 4. The fuse holder 2 has a grip section 6*a*, by means of which the fuse holder 2 in FIG. 1 can be pivoted in the clockwise direction into the operating position of the fuse switch.

The fuse holder 2 is furthermore provided with a receptacle 8, in which a fuse element 9 can be inserted. The receptacle 8 can be formed by lateral connecting webs 10 and a guide web 12 which is injection-molded onto the connecting webs 10. The guide web 12 acts as a bearing face for the fuse element 9. The other bearing face is indicated by the reference numeral 14 and is formed directly on the fuse holder 2 approximately parallel to the guide web 12. A spacing is maintained between the bearing face 14 and the guide web 12, which makes it possible to insert the fuse element 9, for example a cylindrical fuse. As can be seen in FIG. 1 and FIG. 2, the cylindrical fuse element 9 has a main body 9*a*, from which a pin 9*b* protrudes on one side. The pin 9*b* has a smaller diameter than the main body 9*a*.

In this embodiment, the webs 10 define an annular cross section for receiving the cylindrical fuse element. The outer cross section, which is determined by the webs 10 and 12, is smaller than the clear spacing between the arms 23*a*, 23*b*, 24*a*, 24*b* of a sensing or encoding element 15 yet to be described.

In FIG. 1, the fuse element 9 is inserted in the correct position in the fuse holder 2, i.e. the pin 9*b* points in the direction of an encoding element 15. At the end of the fuse holder 2 which points upwards in FIG. 1, preferably a hook section 16 is formed which serves the purpose of preventing the fuse element 9 from unintentionally being moved out of the fuse holder 2 once it has been correctly inserted in the fuse holder 2. Consequently, the hook section 16 slightly overlaps the rear end of the fuse element 9 in the position shown in FIG. 1.

As can be gathered from the above description, the longitudinal axis of the fuse holder 2, which corresponds to the axis of the inserted fuse element 9, is displaced over a predetermined distance with respect to the rotation axis 3. Furthermore, in the embodiment illustrated, the fuse element 9 when inserted correctly is not central with respect to the rotation axis 3, as a result of which, when there is a pivoting movement of the fuse holder 2, said fuse holder 2 need not carry out a precise rotary movement from the position shown in FIG. 1 into the position shown in FIG. 2.

When the fuse element 9 is inserted correctly, it sits in the fuse holder 2 such that the pin 9*b* either bears directly or has only a very small spacing from an arm 15*a* of the encoding element 15. The spacing between the pin 9*b* and the main body 9*a* of the fuse element 9 or the end edge of the main body 9*a* is sufficient in the event of the fuse holder 2 being pivoted in the clockwise direction to gradually spread the arm(s) 15*a* by means of guide faces 32, which are formed such that they extend conically at the free end of the guide web 12, in order to ensure the passage of the fuse element 9 together with the entire receptacle 8 for the fuse element 9 through the encoding element 15. The arms 15*a*, 15*b* thus act as a blocking element.

On the other hand, when the fuse element 9 is inserted the wrong way round, i.e. in the opposite direction to that shown in FIG. 1, the end edge 9*d*, in this case pointing towards the encoding element 15, stops against the arm or the arms 15*a*, 15*a*', as a result of which the fuse holder 2 is prevented from rotating further and, in particular, the pairs of arms 15*a*, 15*a*' are also prevented from being spread apart, as is shown in FIG. 6.

FIG. 2 shows the state in which the fuse holder 2 could be rotated into the operating position when the fuse element 9 is inserted correctly. In this position, the pairs of arms 15*a*, 15*a*' have been spread apart by the guide web 12 when the fuse holder 2 begins to move from the position shown in FIG. 1, with the result that the entire receptacle 8 of the fuse holder 2 could be passed through the encoding element 15. In the position of the fuse element 9 shown in FIG. 2, said fuse element 9 comes into engagement or into contact with the associated contact sections.

Details on the fuse switch according to the invention are described below.

FIG. 3 shows a perspective view, and FIG. 4 a front view, of the encoding element 15 which is shown upside down compared with the position shown in FIG. 1. As can be seen from FIG. 3, the encoding element 15 has the pairs of arms 15*a*, 15*a*'. According to FIG. 1 and FIG. 2, each arm 15*a*, 15*a*' is provided with a beveled face 20, 21 which, in FIG. 1, points in the direction of the fuse element 9. In the non-operational state, the pin 9*b* bears against the point given the reference numeral 22 in FIG. 3 in front of the beveled face 20, 21, with the result that, when the fuse holder 2 is rotated further, each arm 15*a*, 15*a*' is spread apart through the guide by guide faces 32 on the guide web 12 before the fuse holder 2 with its receptacle 8 having the fuse element 9 can be passed through the encoding element 15.

The other pairs of arms 23*a*, 23*b*, 24*a*, 24*b* (FIG. 3), which protrude perpendicularly from a base 25 of the encoding element 15, serve the purpose of fixing or holding the encoding element 15 within the housing 1 or correspondingly formed retaining walls. The encoding element 15 is held reliably within the housing 1 such that it cannot move.

As is further indicated in FIG. 3, the base 25 is cut out approximately in the form of a U such that only the pairs of arms 23*a*, 23*b* are fixedly connected to one another via the base 25, whereas the pairs of arms 24*a*, 24*b* are separated from one another, i.e. are not directly connected to one another in the form of a U, owing to the opening 26 located in the base 25. The opening is necessary for receiving the fuse element 9.

FIGS. 5*a* to 5*c* show various illustrations of the design for the guide web 12.

As can be seen from FIG. 4, the pairs of arms 15*a*, 15*a*' are formed such that they extend in the direction of the center of the encoding element 15, the free ends of the pairs of arms 15*a*, 15*a*' being bent back outwards. These free ends are given the reference numerals 28*a*, 28*b* in FIG. 5. These bent-back arm ends 28*a*, 28*b* act as an opposing guide for the guide web 12.

The encoding element 15 thus has essentially a U-shaped base 25 having pairs of arms 23*a*, 23*b*, 15*a*, 15*a*', 24*a*, 24*b* projecting from the base 25, of which the pairs of arms 15*a*, 15*a*' are arranged approximately centrally with respect to the remaining pairs of arms 23*a*, 23*b*, 24*a*, 24*b* and, according to FIG. 5, are formed such that they extend in the direction of the center or the axis of the encoding element 15.

The guide web 12 is bent back in the form of a hook at the end 12*a* which points towards the encoding element 15 in FIG. 1 and prevents the fuse element 9 from being inserted too deep, whereat the hook 12*a* acts as a stop. FIGS. 5*a* to 5*c* show schematic illustrations or partial illustrations. FIG. 5*a* is a side view, FIG. 5*b* a front view of the guide web 12 and FIG. 5*c* a plan view of the guide web 12 for the purpose of illustrating the obliquely extending faces. The end 30 is bent downwards in the form of a hook and has a section having a conically extending face section 31 which is illustrated in FIG. 4*c* by the reference numerals 31*a*, 31*b*. The faces 31*a*, 31*b* continue into guide ribs 32*a*, 32*b*, the guide ribs 32*a*, 32*b* extending parallel to one another and at the side of the guide web 12.

In the position shown in FIG. 1, each free end 28*a*, 28*b* lies on the corresponding face sections 31*a*, 31*b*, approximately in the region of the curvature 29*a*, 29*b* (FIG. 4), with the result that it is possible to achieve gentle spreading of the arms 15*a*, 15*b* without much frictional resistance when the guide web 12 is passed further through the encoding element 15.

The encoding element 15 is arranged fixedly in the housing 1, whereas the guide web 12 of the fuse holder 2 with its guide faces 31*a*, 31*b*, 32*a*, 32*b* etc. is moved through the encoding element 15, and, in the process, an opening of the arms 15*a*, 15*b* is made possible in the case of a fuse 9 which has been inserted correctly.

It can be seen from FIGS. 5*a*-5*c* that the fuse holder is an integrated part of the grip section 6*a* and is preferably formed on the underside of the grip 6. There is thus formed between the grip section 6*a*, on the one hand, and the guide web 12, on the other hand, a type of receptacle which, as shown in FIG. 5*b*, preferably has an annular cross section and serves the purpose of pushing in the fuse element 9. The guide web 12 is spaced apart from the guide web 14 by a spacing which approximately corresponds to the cross section of the receptacle 8, connecting webs 10*a*, 10*b* being formed between the guide web 14 and the guide web 12, as is shown in FIG. 5*b*.

The rotation of the grip section 6*a* is thus transferred to the fuse holder 2, as a result of which, when the grip 6 is displaced, the fuse holder 2 is correspondingly pivoted about the axis 3 together with the inserted fuse element 9.

As has already been described, during the pivoting movement of the grip 6 and of the fuse holder 2, there is a guiding engagement between the arms 15*a*, 15*b* of the encoding element 15 and the guide web 12, such that the guide web 12 initially enters the interspace between the arms 15*a*, 15*a*' with its tip or its end 12*a* and, provided that the fuse element 9 has been inserted correctly, whilst the fuse holder 2 is moved further through, the arms 15*a*, 15*a*' are spread apart from one another owing to the beveled faces of the guide web 12, as a result of which the entire fuse holder 2 including the fuse element 9 passes through the encoding element. In order to hold the fuse element 9 in a stable manner in the fuse holder 2, projecting away from the web 14 a spring web 34 (FIG. 5*a*) is provided, which contributes to the fact that it is not possible for the fuse element 9 to be displaced from its rest position during the pivoting movement of the fuse holder 2.

As can be seen from FIG. 5*a*, the connecting webs 10*a*, 10*b* are arranged obliquely with respect to the axial line of the webs 12 and 14. As shown in FIG. 5*a*, a guide head 35 is located on the underside of the guide web 12, which has partially curved surfaces 36. This guide head 35 together with the guide web 12 is designed such that the fuse holder formed by these components can be passed through the opening 26 in the encoding element 15.

FIG. 6 shows an illustration corresponding to FIG. 1 with a fuse element inserted the wrong way round. Identical reference numerals to those in FIG. 1 refer to identical parts.

It can be seen from FIG. 6 that, when a fuse element has been inserted the wrong way round or when there is a corresponding fuse element having a greater diameter, the front edge 9*d* protruding into the housing cannot be guided away via the pairs of arms 15*a*, 15*a*', since the edge 9*d* engages with the beveled faces 20, 21 before the guide web 12 can spread apart these pairs of arms 15*a*, 15*a*' at all. The arms 15*a*, 15*a*' thus sense the inserted fuse element 9 and block any further movement of the fuse holder 2.

Regarding the operation of the encoding element, only the arms 15*a*, 15*a*' act as sensing elements for the inserted fuse element 9, whereas the arms 23*a*, 23*b*, 24*a*, 24*b* primarily have the function of holding the encoding element in corresponding recesses or grooves formed by ribs in the two housing shells of the housing 1. Correspondingly, the pairs of arms 23*a*, 23*b*, 24*a*, 24*b* may also have a different shape, for example may be inclined, than that illustrated in FIGS. 3 and 4.

The housing sections, the encoding element and the fuse holder including the grip section 6*a* are preferably made of plastic. Contacts 36 and 37 in FIG. 1 are made of metal and serve the purpose of coming into electrical contact with the corresponding contact sections of the fuse element 9. The contacts 36, 37 are electrically connected to clamping sections 40 or 41 by means of corresponding contact tongues 38 and 39, respectively. As a result, the contact sections 36 and 37 clamp in metallic ring sections 9*d* and 9*e*, respectively, as soon as the fuse element is brought into the appropriate position, so as to produce the electrical contact with the contact clamps 40 and 41, respectively.

The invention claimed is:

1. A fuse switch having a housing for receiving contacts and a fuse holder, which has a receptacle for receiving a fuse element and which is mounted in the housing, wherein said fuse holder is arranged to be pivotable around a pivot point for movement between at least one first and one second operating position, wherein further said housing receives an encoding element, which is provided at least partially in a pivot region of said fuse holder, said encoding element bearing a flexible blocking element extending in the direction of said fuse holder and being provided for sensing the fuse element in terms of its outer diameter, wherein said fuse holder comprises a guide web which can be brought into engagement with said blocking element, wherein said guide web comprises guide faces while said blocking element comprises free ends, said guide faces being able to move or open said free ends during movement of said guide web.

2. A fuse switch having a housing for receiving contacts and a fuse holder, which has a receptacle for receiving a fuse element and which is mounted in the housing, wherein said fuse holder is arranged to be pivotable around a pivot point for movement between at least one first and one second operating position, wherein further said housing receives an encoding element, which is provided at least partially in a pivot region of said fuse holder, said encoding element bearing a flexible blocking element extending in the direction of said fuse holder and being provided for sensing the fuse element in terms of its outer diameter, wherein said fuse holder comprises a guide web which can be brought into engagement with said blocking element, wherein said blocking element comprises blocking arms and said guide web is provided with guide faces, wherein further said blocking arms are arranged to the side of said guide faces of the guide web such that the blocking arms can be moved laterally or spread apart by the guide faces so as to provide a clear cross-sectional area between said blocking arms greater than the cross-sectional area of the fuse element.

3. Fuse switch having a housing for receiving contacts and a fuse holder, which has a receptacle for receiving a fuse element and which is mounted in the housing, wherein said fuse holder is arranged to be pivotable around a pivot point for movement between at least one first and one second operating position wherein further said housing receives an encoding element, which is provided at least partially in a pivot region of said fuse holder, said encoding element bearing a flexible blocking element extending in the direction of said fuse holder and being provided for sensing the fuse element in terms of its outer diameter, wherein said fuse holder comprises a guide web which can be brought into engagement with said blocking element, wherein said blocking element comprises blocking arms and said guide web is provided with guide faces, wherein further said blocking arms are arranged to the side of said guide faces of the guide web such that the blocking arms can be moved laterally or spread apart by the guide faces so as to provide a clear cross-sectional area between said blocking arms greater than the cross-sectional area of the fuse element, wherein said encoding element comprises an essentially U-shaped base, wherein said blocking arms are formed such that they extend away from said base of said encoding element and such that they comprise free ends extending towards one another.

4. Fuse switch according to claim 3, wherein said guide faces of the guide web are provided to hold said free ends of the blocking element arms in the first operating position at a spacing which is smaller than the dimensions of the cross-sectional area of a main body of said fuse element.

5. Fuse switch according to claim 3, wherein said guide faces of the guide web are extending conically with respect to one another.

6. Fuse switch according to claim 3, wherein said guide faces of the guide web are changing into guide ribs, and that said guide ribs are formed parallel to one another on the outer face of the guide web.

7. Fuse switch according to claim 3, wherein said base of said encoding element comprises pairs of guide arms projecting from said encoding element.

8. Fuse switch according to claim 3, wherein said guide web of the fuse holder is fixed to the fuse switch by means of connecting webs which determine an essentially annular passage for the fuse element.

9. Fuse switch having a housing for receiving contacts and a fuse holder, which has a receptacle for receiving a fuse element and which is mounted in the housing, wherein said fuse holder is arranged to be pivotable around a pivot point for movement between at least one first and one second operating position, wherein further said housing receives an encoding element, which is provided at least partially in a pivot region of said fuse holder, said encoding element bearing a flexible blocking element extending in the direction of said fuse holder and being provided for sensing the fuse element in terms of its outer diameter, wherein said fuse holder comprises a guide web which can be brought into engagement with said blocking element, wherein said blocking element comprises blocking arms and said guide web is provided with guide faces, wherein further said blocking arms are arranged to the side of said guide faces of the guide web such that the blocking arms can be moved laterally or spread apart by the guide faces so as to provide a clear cross-sectional area between said blocking arms greater than the cross-sectional area of the fuse element, wherein said encoding element comprises an essentially U-shaped base, wherein said blocking arms are formed such that they extend away from said base of said encoding element and such that they comprise free ends extending towards one another, wherein said guide web of the fuse holder is fixed to the fuse switch by means of connecting webs which determine an essentially annular passage for the fuse element, wherein said guide web and said connecting web have an outer diameter which is smaller than the spacing between the arms of the connecting element.

* * * * *